US005729617A

United States Patent [19]

Gruber

[11] Patent Number: 5,729,617

[45] Date of Patent: Mar. 17, 1998

[54] MAGNET SYSTEM

[75] Inventor: Hermann Gruber, Hunderdorf, Germany

[73] Assignee: Nokia Technology GmbH, Pforzheim, Germany

[21] Appl. No.: 690,322

[22] Filed: Jul. 25, 1996

[30] Foreign Application Priority Data

Jul. 27, 1995 [DE] Germany ..... 29512102 U

[51] Int. Cl.[6] ..... H04R 25/00

[52] U.S. Cl. ..... 381/199; 381/201

[58] Field of Search ..... 381/192, 193, 381/194, 197, 199, 201; 310/13, 14, 15, 23; 335/222, 306, 302, 296

[56] References Cited

U.S. PATENT DOCUMENTS

| | | | |
|---|---|---|---|
| 1,632,332 | 6/1927 | Hayes | 381/199 |
| 3,050,593 | 8/1962 | Cech | 381/194 |
| 3,134,057 | 5/1964 | Tsunoo et al. | 381/199 |
| 3,593,239 | 7/1971 | Hofman | 381/201 |
| 3,763,334 | 10/1973 | Parker | 179/115.5 |
| 4,737,992 | 4/1988 | Latham-Brown et al. . | |
| 4,882,635 | 11/1989 | Sanai . | |
| 4,926,896 | 5/1990 | Prescott et al. . | |
| 5,022,425 | 6/1991 | Prescott et al. . | |
| 5,150,419 | 9/1992 | Kizak et al. . | |
| 5,159,949 | 11/1992 | Prescott et al. . | |
| 5,214,710 | 5/1993 | Ziegnberg et al. . | |
| 5,321,762 | 6/1994 | Stuart | 381/199 |
| 5,364,253 | 11/1994 | Kojima et al. | 425/70 |
| 5,371,486 | 12/1994 | Yamada et al. | 336/212 |
| 5,434,458 | 7/1995 | Stuart | 310/13 |
| 5,536,984 | 7/1996 | Stuart et al. | 310/13 |
| 5,539,262 | 7/1996 | Strugach | 310/13 |

FOREIGN PATENT DOCUMENTS

| | | | |
|---|---|---|---|
| 0341926 | 11/1989 | European Pat. Off. . | |
| 0624049 | 11/1994 | European Pat. Off. | 381/199 |
| 2131035 | 1/1973 | Germany . | |
| 3322021 | 8/1984 | Germany . | |
| 3936639 | 3/1991 | Germany . | |
| 4021651 | 6/1991 | Germany . | |
| 4007678 | 9/1991 | Germany . | |
| 9313631 | 2/1994 | Germany . | |
| 0300696 | 12/1989 | Japan | 381/199 |
| 4048899 | 2/1992 | Japan | 381/199 |
| 4115699 | 4/1992 | Japan | 381/199 |
| 2188790 | 10/1987 | United Kingdom . | |
| 9303586 | 2/1993 | WIPO . | |
| 9511579 | 4/1995 | WIPO . | |
| 9604706 | 2/1996 | WIPO . | |

*Primary Examiner*—Huyen D. Le
*Attorney, Agent, or Firm*—Ware, Fressola, Van Der Sluys & Adolphson LLP

[57] ABSTRACT

The invention presents a magnet system (10) for electromagnetic converters, which is essentially formed of two parts. This magnet system (10) is formed of a one-piece pot-shaped yoke (11), which contains a bottom (13), an edge wall (14) and a core (16), and a permanent magnet (12). This permanent magnet (12), which is either connected to the core (16) or the edge wall (14), is magnetized crosswise to the extended direction of the core axis. This type of configuration permits to construct a very low scatter magnet system (10), whose number of components is clearly reduced with respect to known systems. The connection of yoke (11) and permanent magnet (12) is advantageously made into a press fit connection.

2 Claims, 2 Drawing Sheets

MAGNET SYSTEM

TECHNICAL AREA

The invention concerns the construction of magnet systems for electromagnetic converters, particularly magnet systems for loudspeakers.

BACKGROUND OF THE INVENTION

Magnet systems of this kind are generally constructed with a permanent magnet and a yoke, with an existing air gap into which a coil, which will be driven, is inserted later.

The actual realization is achieved, as a rule, in that a circular permanent magnet is present, whose lower ring surface is equipped with a disk called the lower pole plate. The upper ring surface is most often connected to a circular disk, which is then called the upper pole plate. A core is inserted into the pot formed in this way and is connected to the lower pole plate, where the inside diameter of the upper pole plate and permanent magnet is larger than the diameter of the core. The resulting space A between the core and the inside diameter of the upper pole plate forms the magnet system's air gap, into which the coil dips later. The system comprising the core and the upper and lower pole plate is called a yoke and serves to guide the magnetic flux to the air gap from the permanent magnet which is magnetized in the lengthwise direction of the core.

Other magnet systems are known as well, in which the yoke is essentially pot-shaped, and the core which is inserted into the pot is either made entirely or at least partially of a permanent magnetic material, perhaps by the integration of a disk, where the magnetization direction also extends lengthwise to the core direction. Although the use of cores made entirely of permanent magnetic material is very cost-effective from the production point of view, such systems still have certain disadvantages. For example, if neodymium is used as the permanent magnetic material for reasons of weight, it would not be justifiable to build the entire core of this material, in view of its high cost. A reduction in the size of the system, perhaps resulting in a smaller core made entirely of neodymium, fails because such reduced size magnet systems are very limited with regard to their application possibilities. Therefore, thin neodymium disks are used to prevent such problems, which are connected to a core of the desired diameter at the desired height. If the disk is additionally equipped with a pole body disk on the side that faces away from the bottom of the pot, the result is a reduction of the stray field, because this measure also concentrates the magnetic flux on the core side of the air gap.

For reasons of completeness is should be pointed out that the reduction in the stray field caused by the pole plate or the pole body disks is not limited to the use of neodymium as the magnetic material. But if a magnet system with a low stray field is to be constructed, this means that special measures must be taken to bring this about.

DISCLOSURE OF INVENTION

It is therefore the task of the invention to present a magnet system with a low stray field, which comprises a lower number of components than the known systems.

According to the present invention, a magnet system for electromagnetic converters, which is formed of at least one permanent magnet and one yoke, and contains an air gap to drive a coil inserted into the air gap is characterized in that the yoke is a one-piece pot, and in addition to an edge wall and a bottom, contains a core which extends inside the pot and is surrounded by a space A at a distance from the edge wall, and that the permanent magnet is magnetized crosswise to the extended direction of the core, and is inserted into the space so that a remaining space between the permanent magnet and the part of the yoke which is not connected to the permanent magnet, forms the air gap of the magnet system.

A magnet system according to the invention is further characterized in that the permanent, magnet is attached to the part of the york to which it is connected by means of an iron powder filled adhesive.

A magnet system according to the invention is further characterized in that the connection between the permanent magnet and the part of the yoke to which the permanent magnet is attached is a press fit connection.

A magnet system according to the invention is further characterized in that the respective yoke part, which is connected to the permanent magnet, and the permanent magnet contain complementary mating means in the immediate connection area.

The essential idea of the invention is to build the entire magnet system of two parts only, namely the yoke and the permanent magnet. A one-piece yoke system is obtained by building the entire yoke as a pot, the inside of which also contains a core that is connected to the bottom of the pot and forms a space A with the inside of the pot walls. Such a pot construction can be very simply obtained with a cast-molded part, for example.

The permanent magnet, which is the second component of the magnet system, essentially has a circular shape and is magnetized crosswise to the extension of the core axis. With respect to the permanent magnet, this type of magnetization means that all south magnetic poles for example are on the internal jacket surface, and all north magnetic poles are on the external surface, thus the two magnetic poles are "separated" from each other by the width of the circle.

The thus magnetized permanent magnet is inserted into the space A between the pot wall and the core, and, depending on the construction, is either connected to the wall by its external jacket surface, or to the core by its internal jacket surface. The width of the permanent magnet circle is chosen with respect to the space A between the core and the wall, so that in the connected condition of permanent magnet and the respective yoke part (core or wall) an air gap remains, into which the coil is inserted later.

Since the magnetization of the permanent magnet is crosswise to the extension of the core axis, and in addition the arrangement of the permanent magnet at space A guides the magnetic flux into the air gap like an otherwise conventional pole disk or pole core disk, a reduction of the stray field is achieved without the need for additional means of conduction.

Even if the connection of the permanent magnet to the core or to the wall in accordance with the depiction thus far has an alternative relationship, it does not exclude the possibility of both the core and the wall being equipped with a circular permanent magnet each, and the resulting gap between the opposing surfaces of both permanent magnets forming the air gap of the system.

A good mechanical connection which guides the magnetic flux between the respective yoke part and the permanent magnet is achieved if an adhesive filled with powdered iron is used.

The therefore the connection of the respective yoke part to the permanent magnet may be a press-fit connection. This has the advantage that the use of environmentally harmful adhesives can be avoided when constructing magnet systems. Connecting the permanent magnet to the respective yoke part is particularly simple if at least the respective yoke part and/or the permanent magnet contain guidance means that come into play when the permanent magnet is placed on the respective yoke part for their mutual attachment, or to center the respective permanent magnet with the respective yoke part.

These and other objects, features and advantages of the present invention will become more apparent in light of the detailed description of a best mode embodiment thereof, as illustrated in the accompanying drawing.

BRIEF REPRESENTATION OF THE FIGURES

BEST MODE FOR CARRYING OUT THE INVENTION

The invention will now be explained in greater detail by means of the figures.

Figure 1:
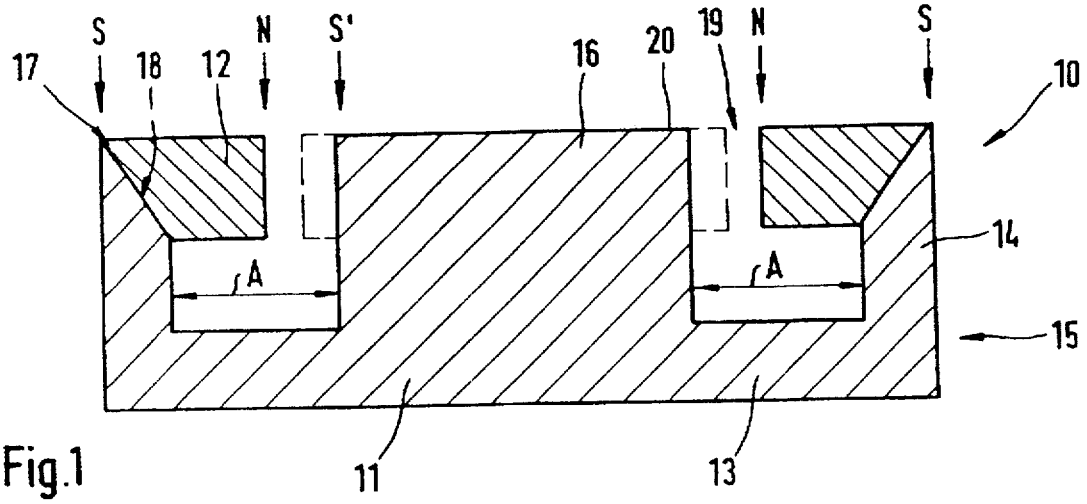
FIG. 1 is a cross section of a magnet system according.

FIG. 1, which like all the other figures does not contain any to-scale illustrations of the relationships to improve the graphic clarity, depicts a magnet system 10 for in loudspeakers, for example according to the present invention. This magnet system 10 is essentially formed of a yoke 11 and a permanent magnet 12.

The yoke 11 is made of one piece having a pot 15 formed of a bottom 13 and an edge wall 14, surrounding a core 16 which is located inside the pot 15 and as suggested is connected to its bottom 13. Since the inside diameter of the edge wall 14 is larger than the diameter of the core 16, and since the construction of system 10 has rotational symmetry, a space A is present between core 16 and edge wall 14. This space A increases somewhat in the direction of the upper end 17 of edge wall 14, because the upper end 17 of the surrounding edge wall 14 is constructed at an angle.

In other words, the yoke 11 has the shape of a pot having a U-shaped cross-section and having a central core located in the middle of the pot, the core having a right circular cylindrical shape with a diameter smaller than the inside diameter of the pot, with the difference in diameters being equal to the space A. The central core is formed in one piece with the pot, and its height may, but need not, terminate at the same level as the edge walls 14 of the pot.

The yoke 11, which is described in the present configuration example and comprises several components, is made of iron and was produced in one piece through casting technology.

The permanent magnet 12, which contains neodymium as the magnetic material, is essentially circular, having an annular disc or annulus shape with one edge sloped. In example of FIG. 1, only the outer edge surface 18 of permanent magnet 12 contains a complementary angle at the upper end 17 of the edge wall 14. In other words it has the shape of a frustrum of a right circular cone (oriented on the yoke with a larger top than bottom radius) and with a right circular cylindrical hole in the center with a diameter smaller than the inside diameter of the edge wall 14 and larger than the diameter of the core 16. How the permanent magnet 12, which is inserted into space A, is connected to the upper end 17 of edge wall 14, will be further explained below in conjunction with FIGS. 4*a–c*.

However, as clearly shown in FIG. 1, the permanent magnet 12 connected to the edge wall 14 does not fill the entire space A, so that an air gap 19 is formed, which serves to receive the (not illustrated) coil later on. In other words, the radius of the right circular cylindrical hole in the center of the permanent magnet is larger than the radius of the core 16. Since the permanent magnet 12 is radially poled—as is made clear by the indicated poles (N, S)—if magnetized crosswisee to the longitudinal direction of a not shown center line of core 16, the north pole (N) in the illustrated configuration example is directly adjacent to the air gap 19. The end of the permanent magnet 12 that faces away from the air gap 19 is connected to the yoke 11, so that the upper end 20 of core 16, which is located next to the air gap 19, forms the south pole (S').

The upper end 20 of pole 16 may also be pole-shaped, insofar as it may be necessary to improve guiding the magnetic flux lines into the air gap. Such a configuration is depicted in FIG. 1 with broken lines.

Figure 2:
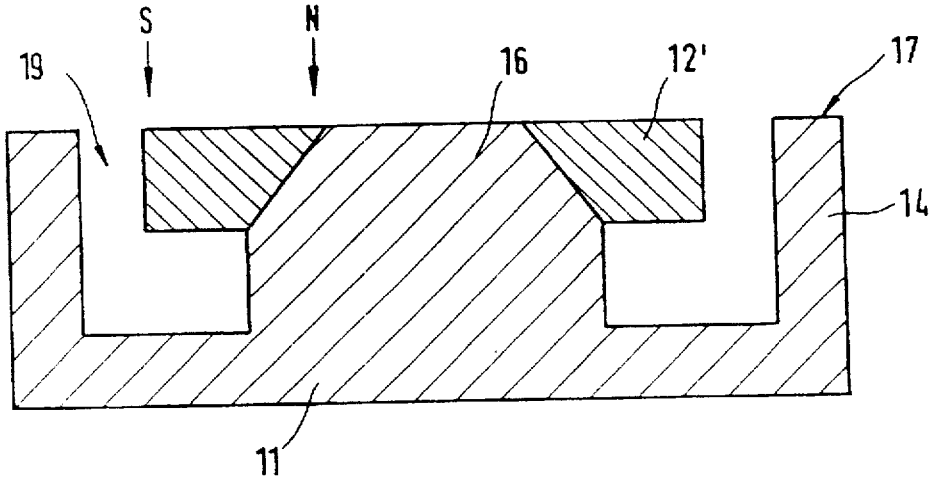
FIG. 2 is illustration of FIG. 1.

The illustration in FIG. 2 only differs from the illustration in FIG. 1 in that the permanent magnet 12' is not connected to the edge wall 14, but to the core 16 of yoke 11. The permanent magnet has a right circular cylindrical or annular disc shape with a central opening or hole having the shape of a frustrum of right circular cone that fits over and mates with a similarly shaped but inverted top portion of the core 16. Insofar as required, the upper end 17 of the edge wall 14 in this configuration example can be pole-shaped as well (not illustrated).

Figure 3:
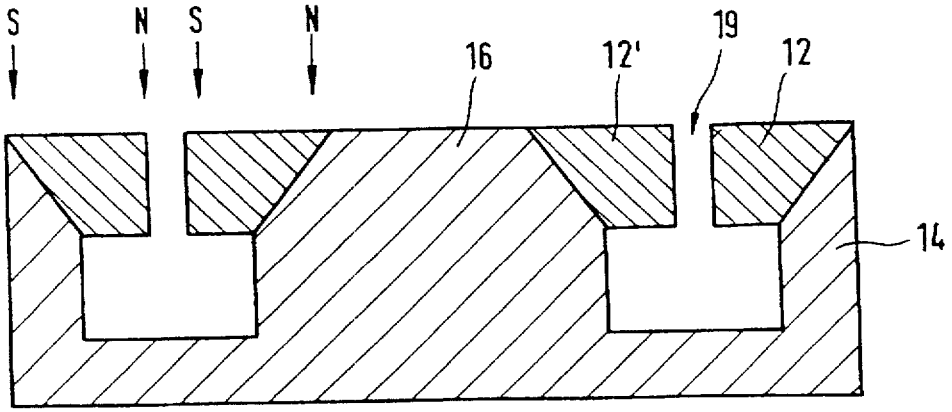
FIG. 3 is an illustration of yet another embodiment of a magnet system according to the present invention.

The illustration in FIG. 3 shows a combination of FIG. 1 and 2. In this configuration example both the edge wall 14 and the core 16 are equipped with an annular permanent magnet each 12, 12', where directly opposite surfaces of both permanent magnets 12, 12' are separated by the air gap 19. Although splitting the permanent magnetic mass into two magnets 12, 12' may be necessary as a function of the geometry of magnetic system 10 and the magnetic material being used, it has however the disadvantage that by doubling the boundary surfaces between the yoke 11 and the permanent magnets 12, 12', the induction in the air gap 19 easily decreases with respect to an arrangement as in FIG. 1 or FIG. 2, which contains only one boundary surface. However, if this disadvantage can be tolerated, an arrangement as illustrated in FIG. 3 has the advantage of forming a very low scatter magnet system 10, because the pole-shaped configuration of both permanent magnets 12, 12' guides the magnetic flux lines directly into the air gap 19.

Figure 4A:
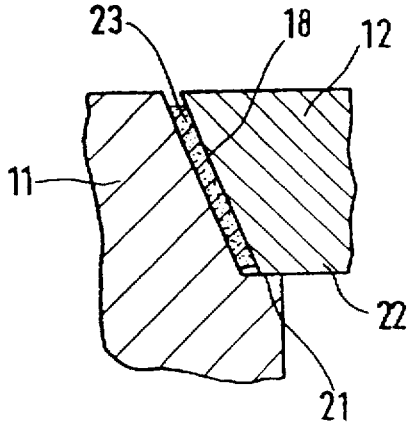
FIGS. 4*a–c* are details of three connections between the part and the magnet part.

FIG. 4*a* illustrates a connection between a part of the yoke 11 and the permanent magnet 12. It can clearly be seen that the shape of the connected parts 11, 12 is mutually complementary in the connection area. This complementary shape guides and centers the permanent magnet 12 when it is connected to the yoke 11. That part of the yoke 11 has an additional step 21, on which the lower circular surface 22 of permanent magnet 12 rests when it takes up its final position in space A shown in FIG. 1 (not shown in FIG. 4*a*). In the present configuration example, this step 22 has the function of a bottom stop. The connection of yoke 11 and permanent magnet 12 in FIG. 4*a* is achieved with an iron powder filled adhesive 23.

Figure 4B:
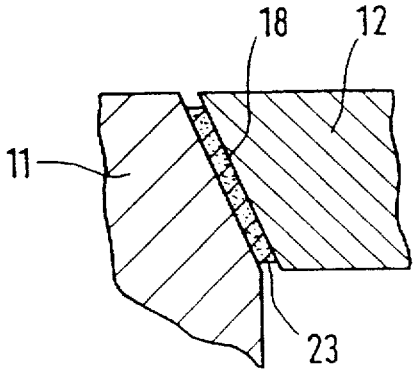

The illustration in FIG. 4*b* only differs from the illustration in FIG. 4*a* in that the formation of a step 23 in yoke 11 has been omitted.

Figure 4C:
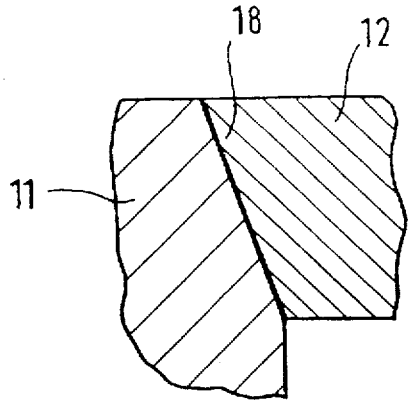

FIG. 4*c* illustrates a press fit connection between yoke 11 and permanent magnet 12. Depending on the circumstances, this press fit connection can be a contracted connection, in that both parts 11, 12 are at different temperatures when being joined together, and/or different heat expansion characteristics of both parts 11, 12 are utilized for the junction. Deviating from this, both parts 11, 12 can also be cold pressed into a press fit connection. Such a press fit connection ensures that both parts 11, 12 are joined against each other without any gap, which in contrast to the connection achieved with adhesive technology further reduces induction losses in the transition from permanent magnet 12 to yoke 11.

I claim:

1. Magnet system for electromagnetic converters, which is formed of at least one permanent magnet (12) and one yoke (11), and contains an air gap (19), wherein the yoke (11) is a one-piece pot (15), formed of an edge wall (14), a bottom (13), and a core (16) which extends inside the pot (15) and is surrounded by a space (A) at a distance from the edge wall (14);

wherein the permanent magnet (12) is magnetized crosswise to the extended direction of the core (16), and is inserted into the space (A) so that a remaining space between the permanent magnet (12) and a part (16) of the magnet system which is not connected to the permanent magnet (12), forms the air gap (19) of the magnet system (10) and wherein an upper end (17) of the edge wall (14) is formed at an angle for mating with a respective angled edge of the permanent magnet thereby forming complementary mating means;

wherein the complementary mating means for the yoke part that is formed on the edge wall is connected to the permanent magnet (12), the permanent magnet having an annular form with said respective angled edge of the permanent magnet (12) located in an outer edge thereof;

wherein the permanent magnet (12) has a shape of a frustrum of a right circular cone oriented on the edge wall of the yoke with a top radius larger than a bottom radius and with a right circular cylindrical hole in a center of the permanent magnet with a diameter smaller than an inside diameter of the edge wall and larger than an outside diameter of the core.

2. Magnet system for electromagnetic converters, which is formed of at least one permanent magnet (12') and one yoke (11), and contains an air gap (19), wherein the yoke (11) is a one-piece pot (15), formed of an edge wall (14), a bottom (13), and a core (16) which extends inside the pot (15) and is surrounded by a space (A) at a distance from the edge wall (14), wherein the permanent magnet (12') is magnetized crosswise to the extended direction of the core (16), and is inserted into the space (A) so that a remaining space between the permanent magnet (12') and a part (14) of the magnet system which is not connected to the permanent magnet (12'), forms the air gap (19) of the magnet system (10) and wherein an upper end of the core (16) is formed With an angled edge for mating with an inner angled edge of the permanent magnet thereby forming complementary mating means;

wherein the upper end of the core of the yoke has said angled edge for said mating to an inner edge of the permanent magnet (12');

and wherein the permanent magnet has a right circular cylindrical or annular disk shape with a central opening having a shape of a frustrum of a right circular cone to form said inner angled edge of the permanent magnet for mating with said angled edge of said upper end of the core of the yoke.

* * * * *

UNITED STATES PATENT AND TRADEMARK OFFICE

CERTIFICATE OF CORRECTION

PATENT NO. : 5,729,617

DATED : March 17, 1998

INVENTOR(S) : Gruber

It is certified that error appears in the above-identified patent and that said Letters Patent is hereby corrected as shown below:

In the printed patent, column 6, line 23, (line 15 of claim 2)

"With" should read --with--.

Signed and Sealed this

Seventh Day of July, 1998

Bruce Lehman

*Attest:*

BRUCE LEHMAN

*Attesting Officer*

*Commissioner of Patents and Trademarks*